US012714226B2

(12) United States Patent
Crawford et al.

(10) Patent No.: US 12,714,226 B2
(45) Date of Patent: Aug. 25, 2026

(54) HIGH-LEG CHAIR AND MECHANISM WITH IMPROVED OTTOMAN

(71) Applicant: L&P Property Management Company, South Gate, CA (US)

(72) Inventors: Cheston Brett Crawford, Randolph, MS (US); Gregory Mark Lawson, Tupelo, MS (US)

(73) Assignee: L&P Property Management Company, Carthage, MO (US)

( * ) Notice: Subject to any disclaimer, the term of this patent is extended or adjusted under 35 U.S.C. 154(b) by 12 days.

(21) Appl. No.: 18/651,181

(22) Filed: Apr. 30, 2024

(65) Prior Publication Data

US 2024/0365980 A1 Nov. 7, 2024

Related U.S. Application Data

(60) Provisional application No. 63/464,328, filed on May 5, 2023.

(51) Int. Cl.

| | |
|---|---|
| ***A47C 1/034*** | (2006.01) |
| ***A47C 1/032*** | (2006.01) |
| ***A47C 1/035*** | (2006.01) |
| ***A47C 1/0355*** | (2013.01) |

(52) U.S. Cl.

CPC ..... *A47C 1/0355* (2013.01); *A47C 1/03211* (2013.01); *A47C 1/034* (2013.01); *A47C 1/0342* (2013.01); *A47C 1/0345* (2013.01); *A47C 1/035* (2013.01)

(58) Field of Classification Search

CPC ..... A47C 1/034; A47C 1/0342; A47C 1/0345; A47C 1/035; A47C 1/0355

See application file for complete search history.

(56) References Cited

U.S. PATENT DOCUMENTS

| | | | | |
|---|---|---|---|---|
| 4,386,803 | A | 6/1983 | Gelderbloom | |
| 7,766,421 | B2 | 8/2010 | Lawson | |
| 8,911,009 | B2 * | 12/2014 | Hoffman | A47C 1/03272 297/84 X |
| 9,844,269 | B2 * | 12/2017 | Bryant | A47C 1/0242 |
| 10,278,510 | B2 * | 5/2019 | Lawson | A47C 7/506 |
| 10,299,596 | B2 * | 5/2019 | White | A47C 1/0355 |
| 10,485,347 | B2 * | 11/2019 | Lawson | A47C 1/0355 |

(Continued)

FOREIGN PATENT DOCUMENTS

WO WO-2019140172 A1 * 7/2019 ..... A47C 1/0342

OTHER PUBLICATIONS

International Search Report and Written Opinion received for PCT Patent Application No. PCT/US2024/027633, mailed on Jul. 23, 2024, 8 pages.

(Continued)

*Primary Examiner* — Rodney B White

(74) *Attorney, Agent, or Firm* — Shook, Hardy & Bacon L.L.P.

(57) ABSTRACT

A high leg seating unit is disclosed herein. The seating unit comprises two sides spaced from one another, a seat extending between the two sides, and an extendable ottoman having a mid-ottoman, a main ottoman, and a flipper ottoman. The chair is operable by a linkage mechanism having a first void for accommodating the mid-ottoman in the closed position and a second void for accommodating the flipper ottoman in the closed position.

20 Claims, 18 Drawing Sheets

(56) References Cited

U.S. PATENT DOCUMENTS

| | | | | |
|---|---|---|---|---|
| 10,602,854 | B2 | 3/2020 | Gu et al. | |
| 10,709,246 | B2 | 7/2020 | Murphy | |
| 10,729,251 | B2 * | 8/2020 | Lawson | A47C 1/0355 |
| 11,241,094 | B2 * | 2/2022 | Murphy | A47C 3/0255 |
| 12,408,755 | B2 * | 9/2025 | Lake | A47C 1/0355 |
| 2010/0283297 | A1 * | 11/2010 | Crum | A47C 7/50 297/84 |
| 2015/0054316 | A1 | 2/2015 | Donovan et al. | |
| 2016/0029800 | A1 * | 2/2016 | Bryant | A47C 1/0242 297/284.3 |
| 2018/0242742 | A1 | 8/2018 | Lawson et al. | |
| 2019/0298070 | A1 * | 10/2019 | Lawson | A47C 1/0355 |

OTHER PUBLICATIONS

International Search Report and Written Opinion received for PCT Patent Application No. PCT/US2024/027992, mailed on Sep. 11, 2024, 12 pages.

International Preliminary Report on Patentability received for PCT Patent Application No. PCT/US2024/027633, mailed on Nov. 20, 2025, 8 pages.

International Preliminary Report on Patentability received for PCT Patent Application No. PCT/US2024/027992, mailed on Nov. 20, 2025, 7 pages.

Non-Final Office Action received for U.S. Appl. No. 18/651,128, mailed on Jan. 22, 2026, 15 pages.

* cited by examiner

HIGH-LEG CHAIR AND MECHANISM WITH IMPROVED OTTOMAN

CROSS-REFERENCE TO RELATED APPLICATIONS

This application titled "High-Leg Chair and Mechanism with Improved Ottoman", claims the benefit of priority of U.S. Application No. 63/464,328, filed May 5, 2023, and titled "High-Leg Chair and Mechanism with Improved Ottoman". The entirety of the aforementioned application is incorporated by reference herein.

TECHNICAL FIELD

Aspects herein relate to a chair and a mechanism for use on a chair that has an improved ottoman motion and positioning for use on a high-leg chair.

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "recliners." More particularly, the present invention relates to an improved all-linkage powered reclining mechanism allowing a high-leg styling (with its slim profile) and clean look, and that also allows an improved ottoman motion and positioning.

Recliners exist that typically provide three basic positions: a normal non-reclined sitting position with the seat generally horizontal and the back substantially upright; a partially reclined position often referred to as a "TV" position with an extended ottoman and with the seat and back disposed in a slightly reclined position but with the back still sufficiently upright to permit comfortable television viewing from the recliner; and a fully reclined position with the back pivoted toward horizontal into an obtuse relationship with the seat for lounging or sleeping. It would also be desirable to provide a recliner mechanism with a low profile that allows a high-leg styling, while also providing a recliner mechanism where the ottoman can be extended to a TV position and a fully reclined position, with multiple ottoman sections adjacent one another to provide a continuous (or near continuous) support surface. It would also be desirable to provide a mechanism easily installed on the chair, and that allows the pitch of the seat to change when moving from the closed position to the TV and fully reclined positions. Further, it would be desirable to provide a recliner mechanism that achieves such a motion while allowing a high-leg (wood-to-floor) mechanism, and a wing-over-arm T-cushion styled chair back.

Aspects herein are directed to a high leg seating unit moveable between closed, extended and fully reclined positions, the seating unit comprising two sides spaced from one another, each side having a lower edge and an upper edge spaced apart from the lower edge, a seat extending between the two sides, an extendable ottoman including a mid-ottoman, a main ottoman and a flipper ottoman. The high leg seating unit further comprises a chair back extending upwardly from a rearward edge of the seat, a linkage mechanism supported between the sides and coupling at least the seat, the extendable ottoman, and the chair back, the linkage mechanism including an ottoman linkage with links shaped to create a first void accommodating the mid-ottoman in the closed position and a second void accommodating the flipper ottoman in the closed position, and a motor coupled to the linkage mechanism to move the seating unit between the closed, extended and fully reclined positions.

Further aspects are directed to a high leg seating unit adjustable between closed, extended and fully reclined positions, the high leg seating unit comprising two sides and a seat extending between the two sides, a mid-ottoman, a main ottoman and a flipper ottoman forming an ottoman assembly, a chair back coupled to the seat. The high leg seating unit further comprises a linkage mechanism supported between the sides and coupling at least the seat, the ottoman assembly and the chair back, wherein the linkage mechanism includes an ottoman linkage, the ottoman linkage comprising links shaped to create a first void accommodating the mid-ottoman in the closed position and a second void accommodating the flipper ottoman in the closed position; and a motor coupled to the linkage mechanism to move the seating unit between the closed, extended and fully reclined positions.

Further aspects are directed to an adjustable seating unit, comprising a seat and two sides, a mid-ottoman, a main ottoman and a flipper ottoman, a chair back coupled to the seat, a linkage mechanism coupled to at least the seat, the mid-ottoman, the main ottoman, the flipper ottoman and the chair back, wherein the linkage mechanism comprises a plurality of links shaped to create a first void for accommodating the mid-ottoman and a second void for accommodating the flipper ottoman, and a motor coupled to the linkage mechanism to move the seating unit between a closed, an extended and a fully reclined position.

BRIEF DESCRIPTION OF THE DRAWINGS

Examples of aspects herein are described in detail below with reference to the attached drawings figures, wherein.

DETAILED DESCRIPTION

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies.

Figure 5:
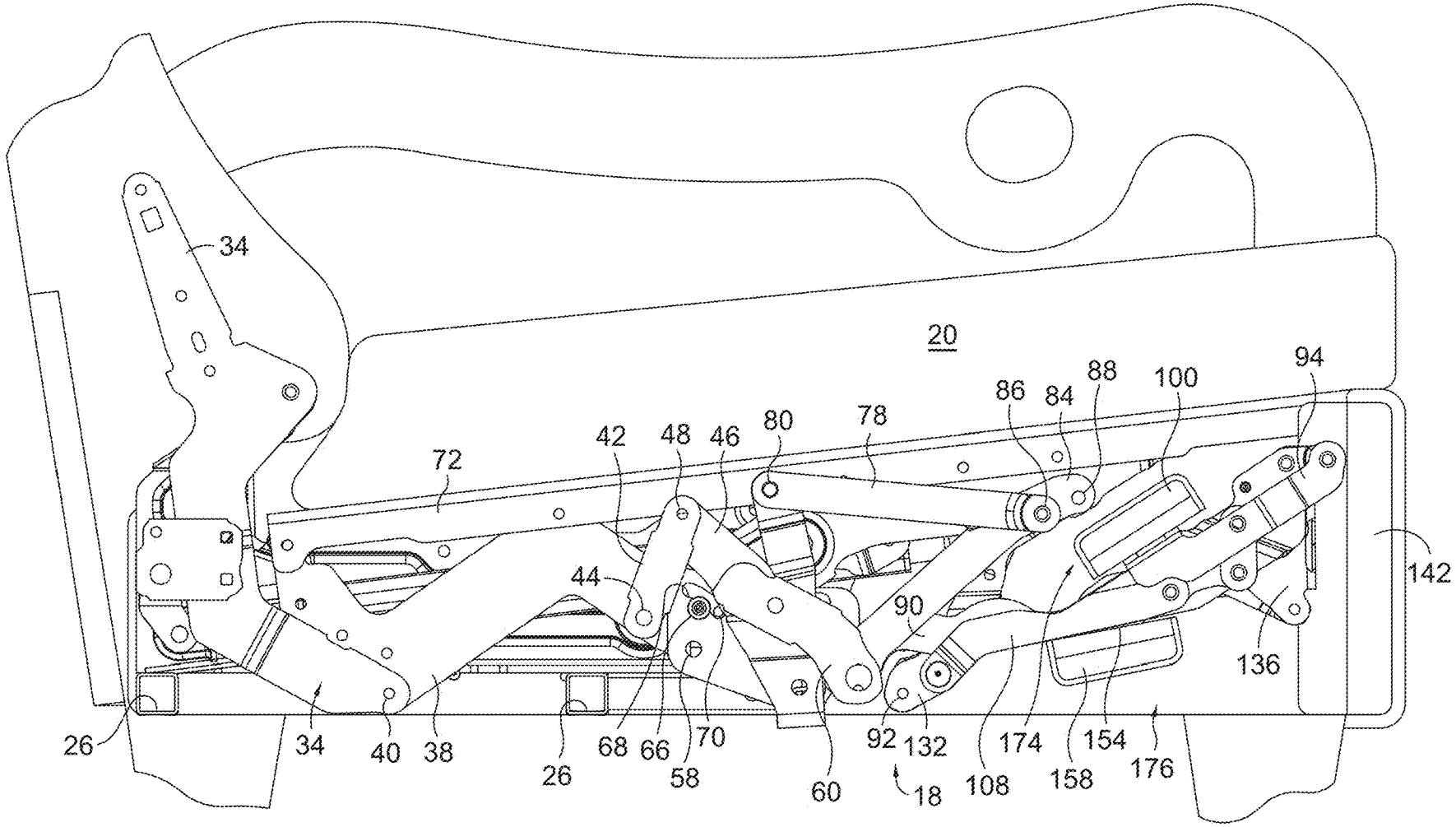
FIG. 5 is a view similar to FIG. 4, but shown with the ottoman side shrouds hidden.
Figure 6:
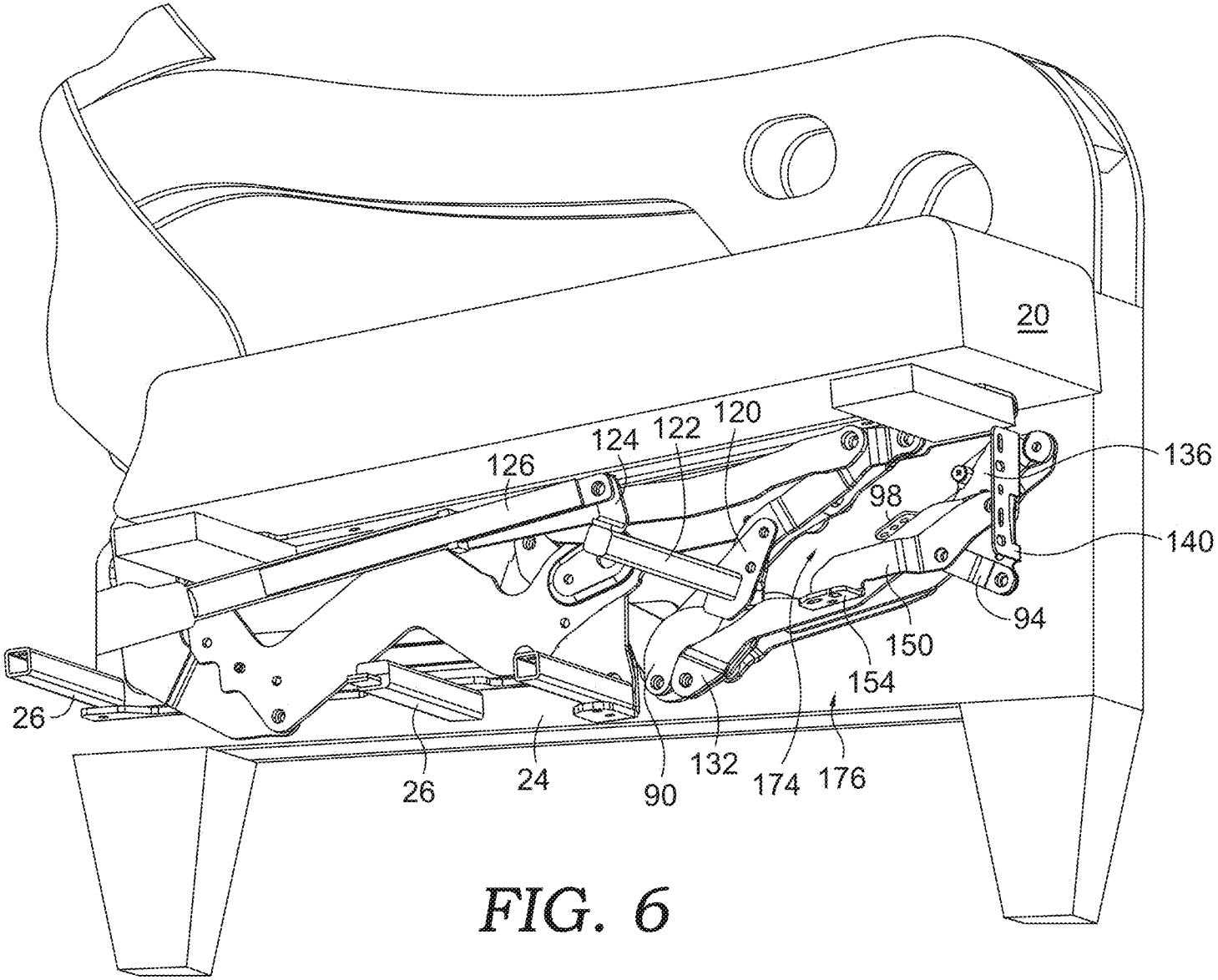
FIG. 6 is a partial, enlarged section view of FIG. 5, shown with the ottoman boards hidden from view in accordance with aspects herein.
Figure 7:
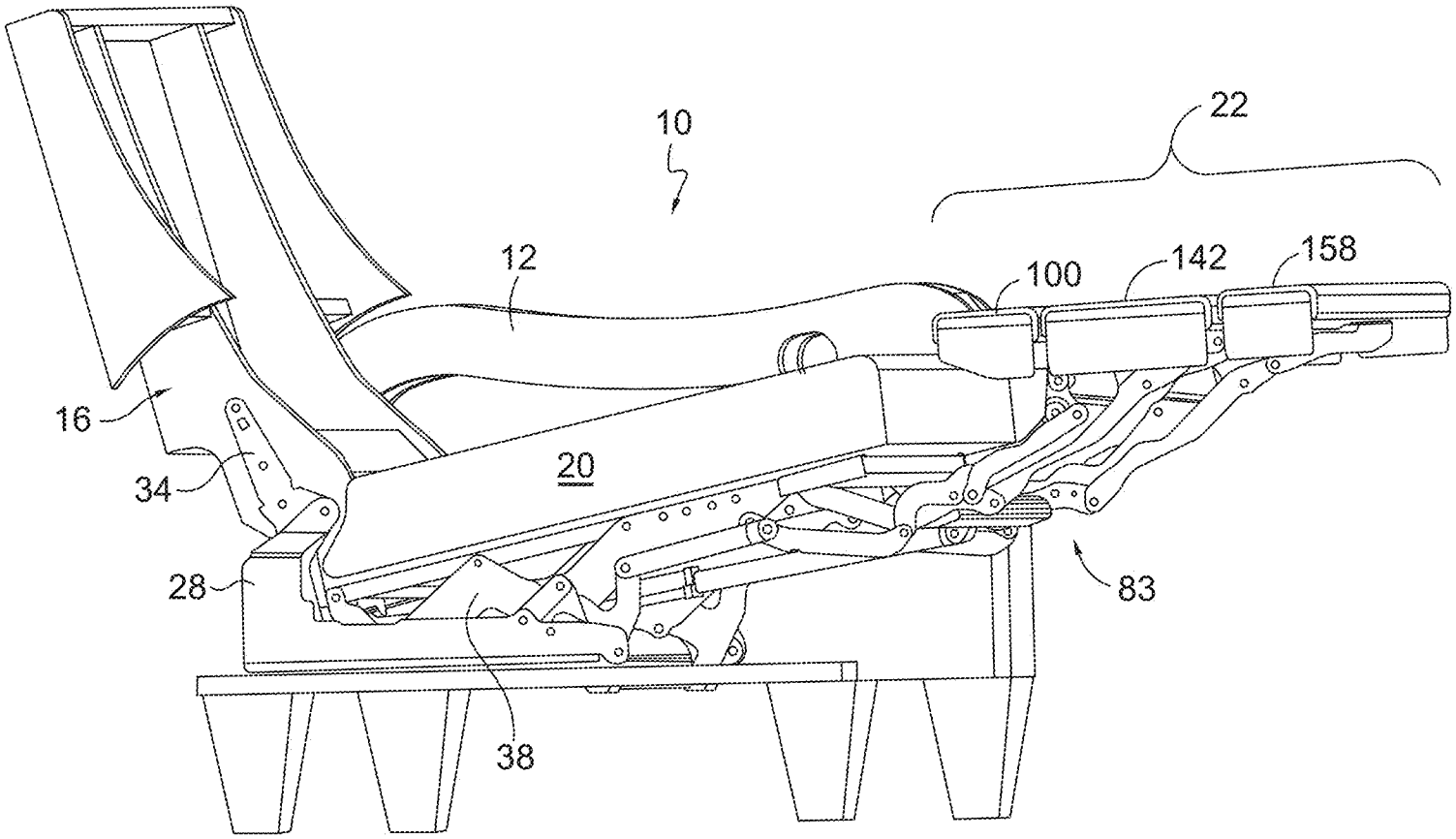
FIG. 7 is a perspective view similar to FIG. 2, but shown in the TV position.
Figure 8:
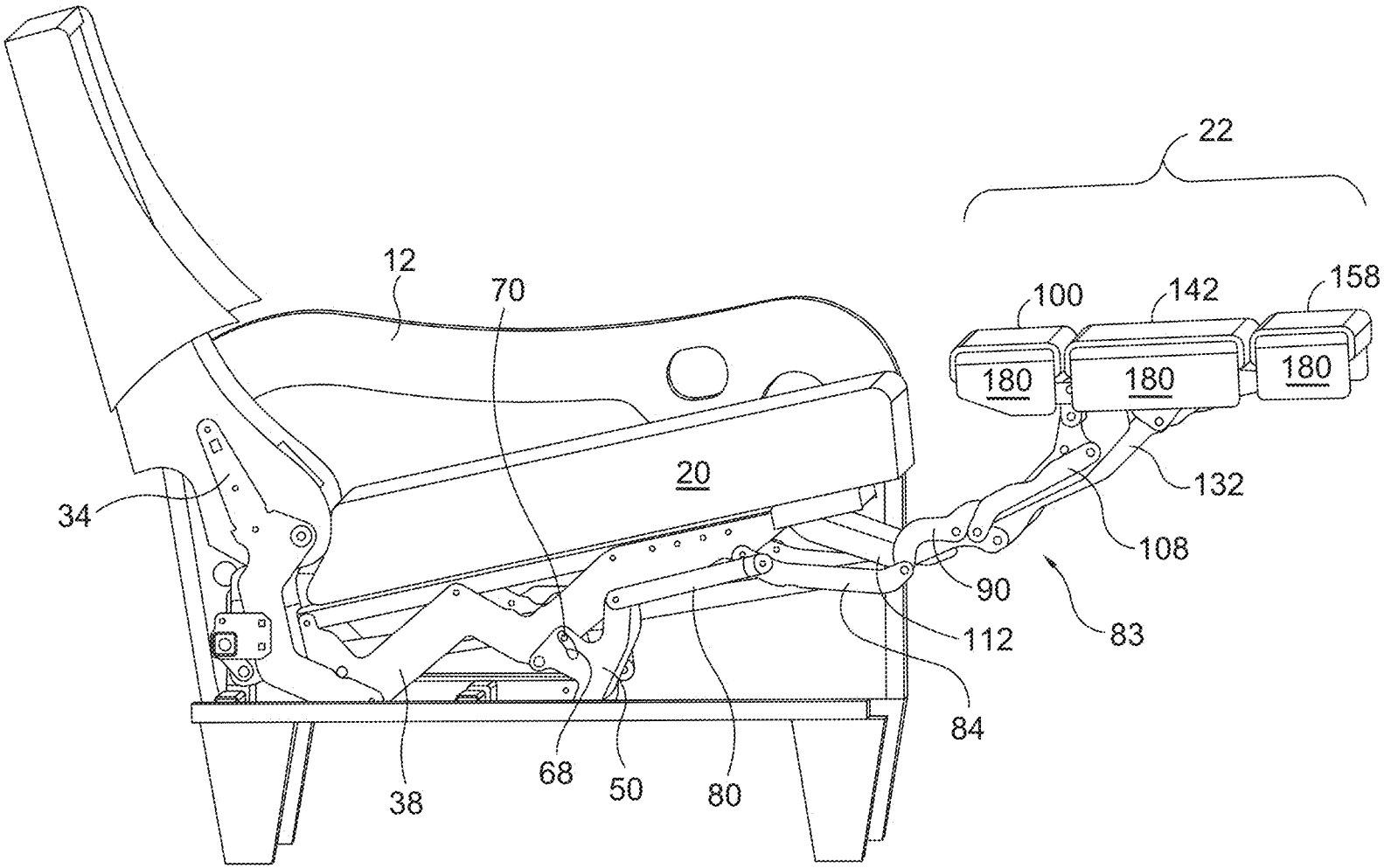
FIG. 8 is a view similar to FIG. 7, but shown with the baseplate hidden.

FIGS. 1-6B depict a chair 10 in a closed position, FIGS. 7 and 8 depict the chair 10 in an extended or TV position, and FIGS. 9-12 depict the chair 10 in a fully reclined position. The chair 10 is shown without upholstery on the arms and back, for simplicity. The chair 10 may include a pair of spaced apart arms 12, suspended above the floor by legs 14. The arms 12 are shown as a wooden frame that would in practice have padding and upholstery, which is not shown here for the sake of simplicity. While the arms 12 are shown as having a stylistic shape, it should be understood that other shapes and styles could be used for the arms 12. As shown, the bottoms of the arms are suspended above the floor by the legs 14, in a styling known as "high-leg". The chair 10 further includes a back 16 pivotally coupled between the arms 12 via a mechanism generally designated as 18. The mechanism 18 further carries a seat 20 and an extendable ottoman broadly designated as 22 as best seen in FIG. 7) between the arms 12. The mechanism 18 is an all-linkage assembly, and controls the movement of the chair 10 between the closed position (FIG. 1), the TV position (FIG. 7) and the fully reclined position (FIG. 10), as further described below.

Figure 12:
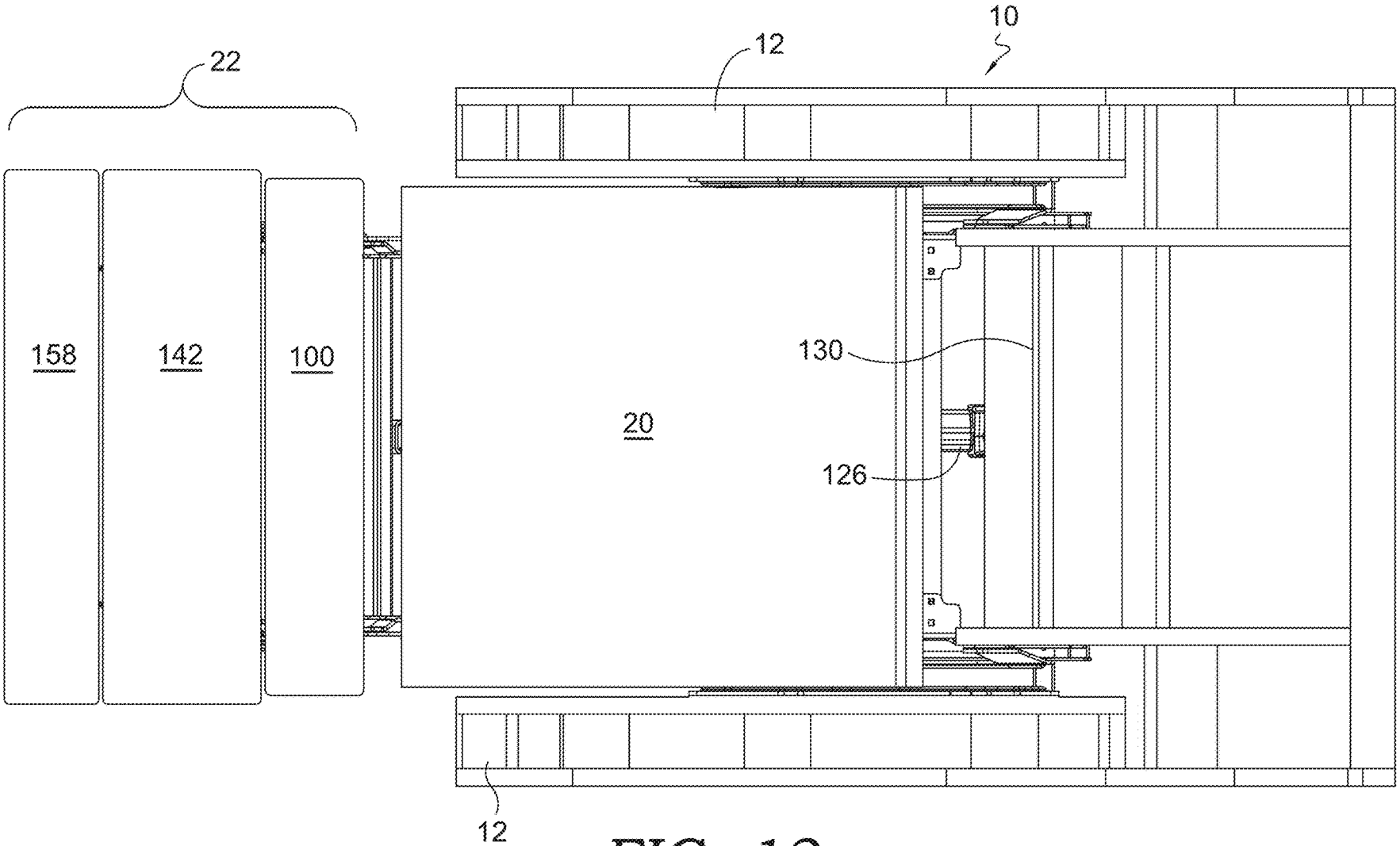
FIG. 12 is a top view of the chair in the position of FIG. 9.

In this movement, the mechanism 18 the linkage carrying the ottoman 22 to be located inwardly of the chair arms and to extend for the full width of the seat (as seen in FIG. 12) for a better aesthetic. As shown in FIG. 3, the mechanism 18 allows use on a high-leg chair with a clean bottom line (with the mechanism 18 hidden from view by the bottom of the arms 12). The mechanism 18 is also designed to have a compact design in the closed position of FIG. 3, allowing a high-leg styling. Moreover, the mechanism 18 is easily coupled to the chair 10, being carried by a chassis as more-fully described below. As the mechanism 18 moves to the TV position, it changes the pitch of the seat 20, increasing the pitch from the back to the front, for increased comfort of the user. The mechanism 18 further allows a wing-back T-cushion design that allows the wing-back (such as back 16) to pivot over stationary arms (such as arms 12) (compare FIGS. 2, 7 and 9).

Figure 1:
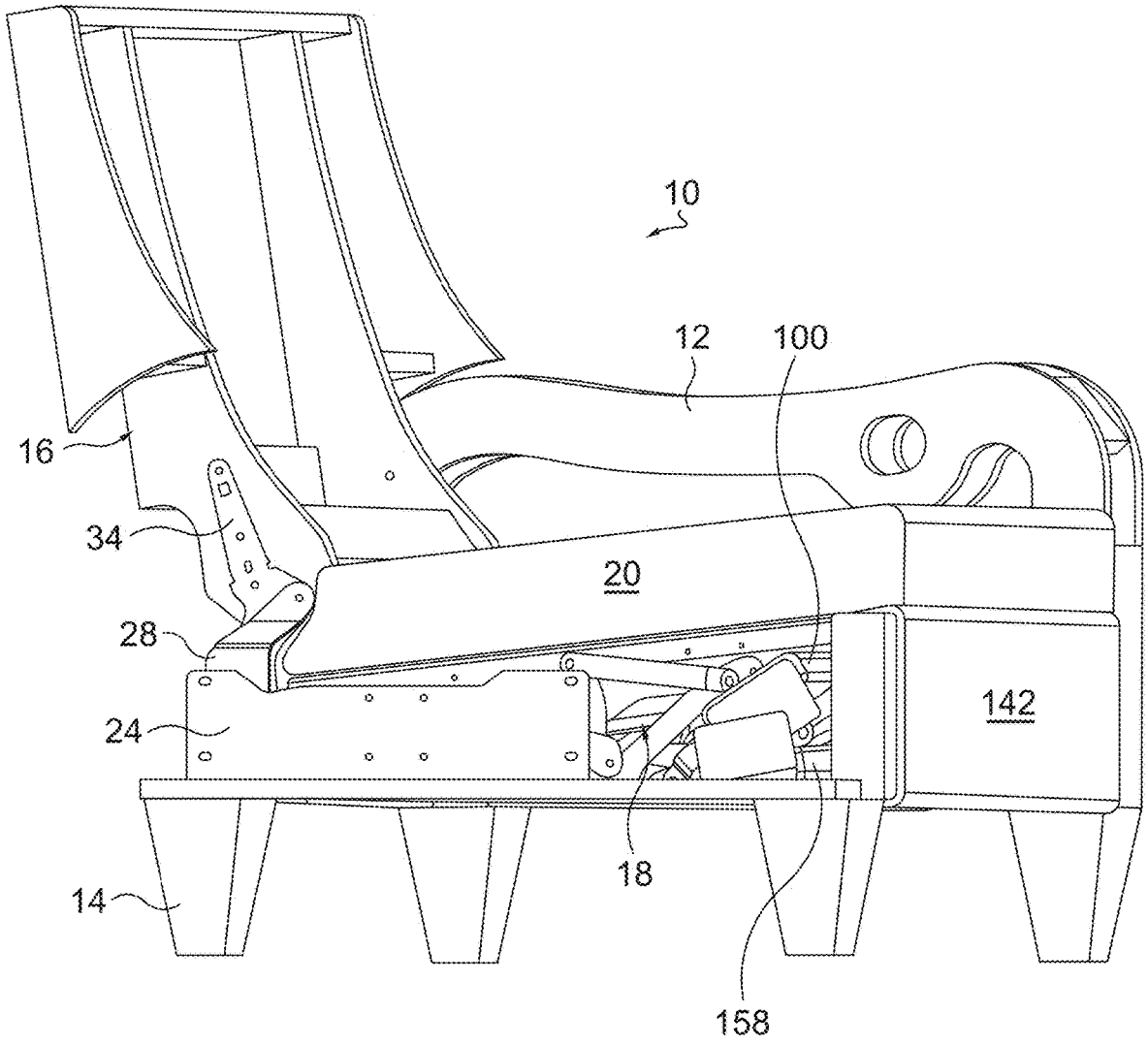
FIG. 1 illustrates a side perspective view of a chair (shown without some framing and upholstery) in the closed position, in accordance with aspects herein.
Figure 2:
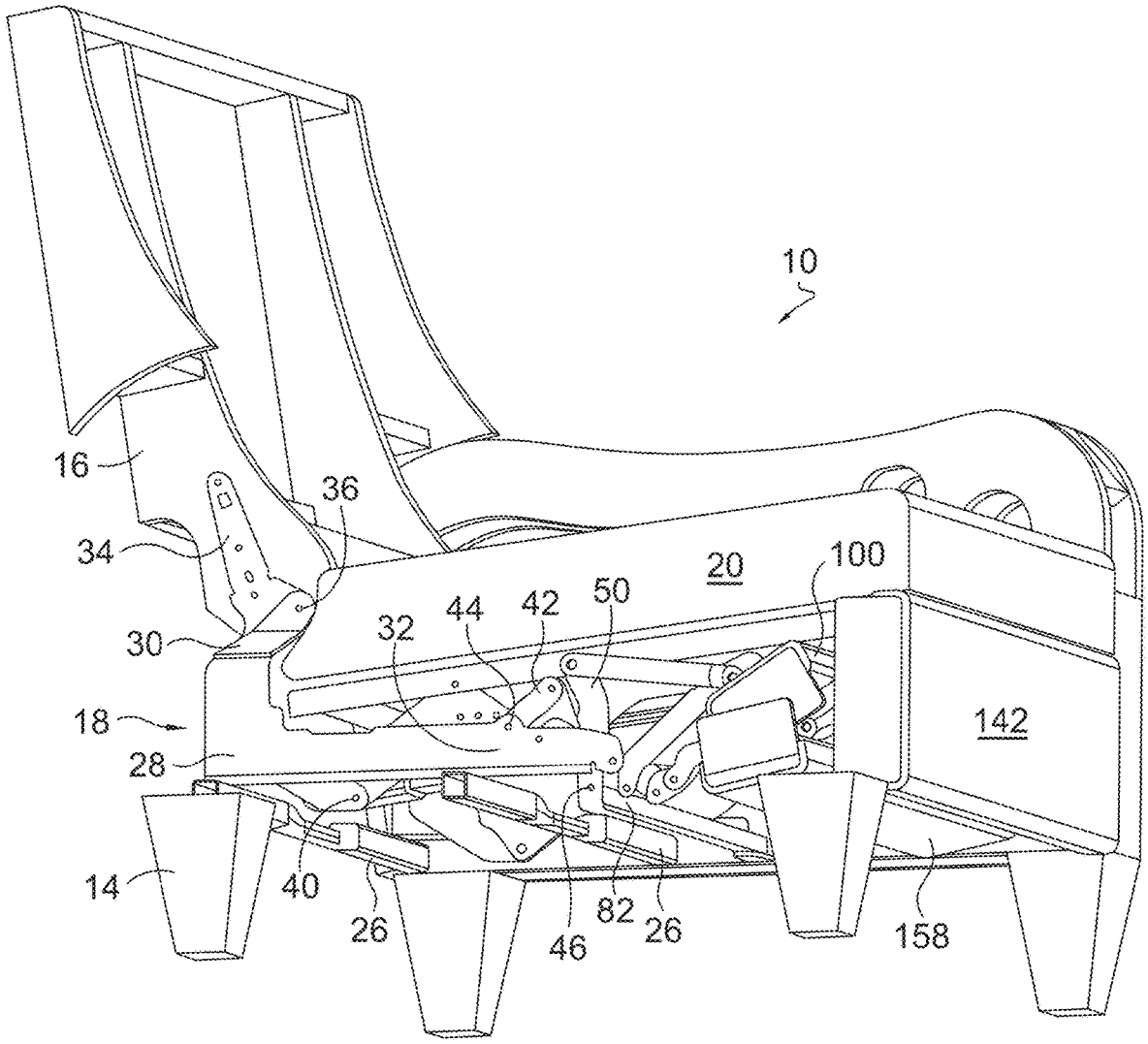
FIG. 2 illustrates a view of the chair of FIG. 1, with the chassis plate and some additional framing removed, in accordance with aspects herein.
Figure 3:
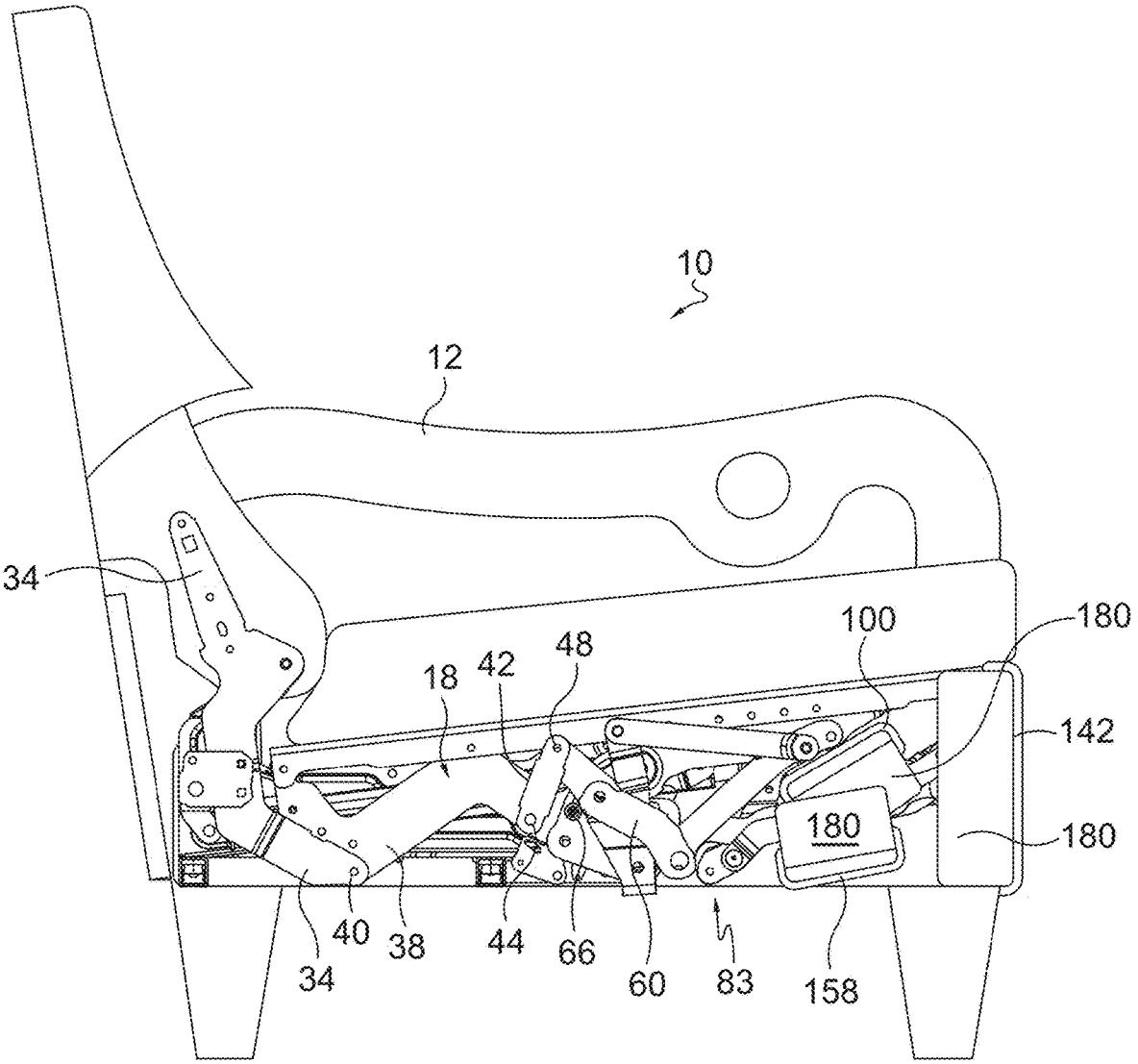
FIG. 3 illustrates a side view of the chair of FIG. 1, shown with the baseplate hidden, in accordance with aspects herein.

As shown in FIGS. 1 and 2, the mechanism 18 is carried between the arms 12 via a chassis plate 24. Each arm 12 thus has a corresponding chassis plate 24 fixedly coupled thereto. FIG. 2 shows a view with one of the chassis plates 24 hidden from view. As seen in FIG. 2, the chassis plates 24 are coupled to one another via a pair of rigid cross-tubes 26. In some aspects, each cross-tube 26 has a lower-profile central section (see FIG. 2) that provides clearance for a motor, as further described below. Each cross-tube 26 supports a base plate 28, with a flange of the base plate 28 being rigidly coupled (such as by bolting) to the cross-tubes 26. With the chassis plates 24 and the cross-tubes 26, the remainder of the mechanism 18 is more easily installed on the chair 10.

The base plates 28 carry the back 16 and seat 20 (and indirectly, the ottoman 22) through other links of the mechanism 18. As seen in FIGS. 1, 2 and 7, each base plate 28 includes an inwardly extending back portion 30 that is pivotally coupled to a back bracket 34 at pivot point 36. The upper end of the back bracket 34 is rigidly coupled to the back 16. In some aspects, the back bracket 34 may allow a quick coupling (such as might be needed for ease of shipping and assembly) known as a KD bracket. As seen in FIG. 3, the lower end of the back bracket 34 is pivotally coupled to a seat plate 38 at pivot point 40.

Figure 4:
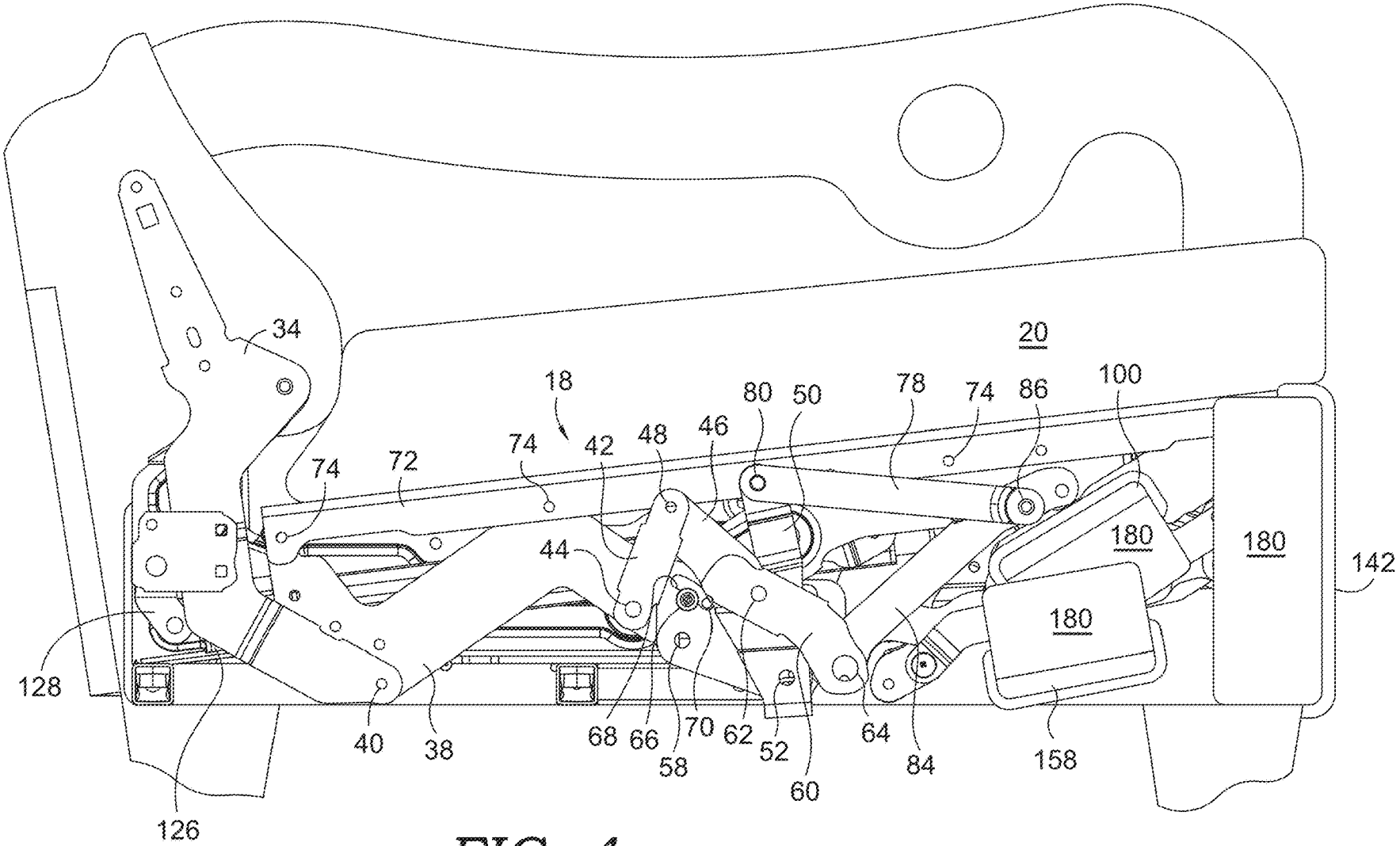
FIG. 4 is an enlarged partial view of the chair of FIG. 3.
Figure 9:
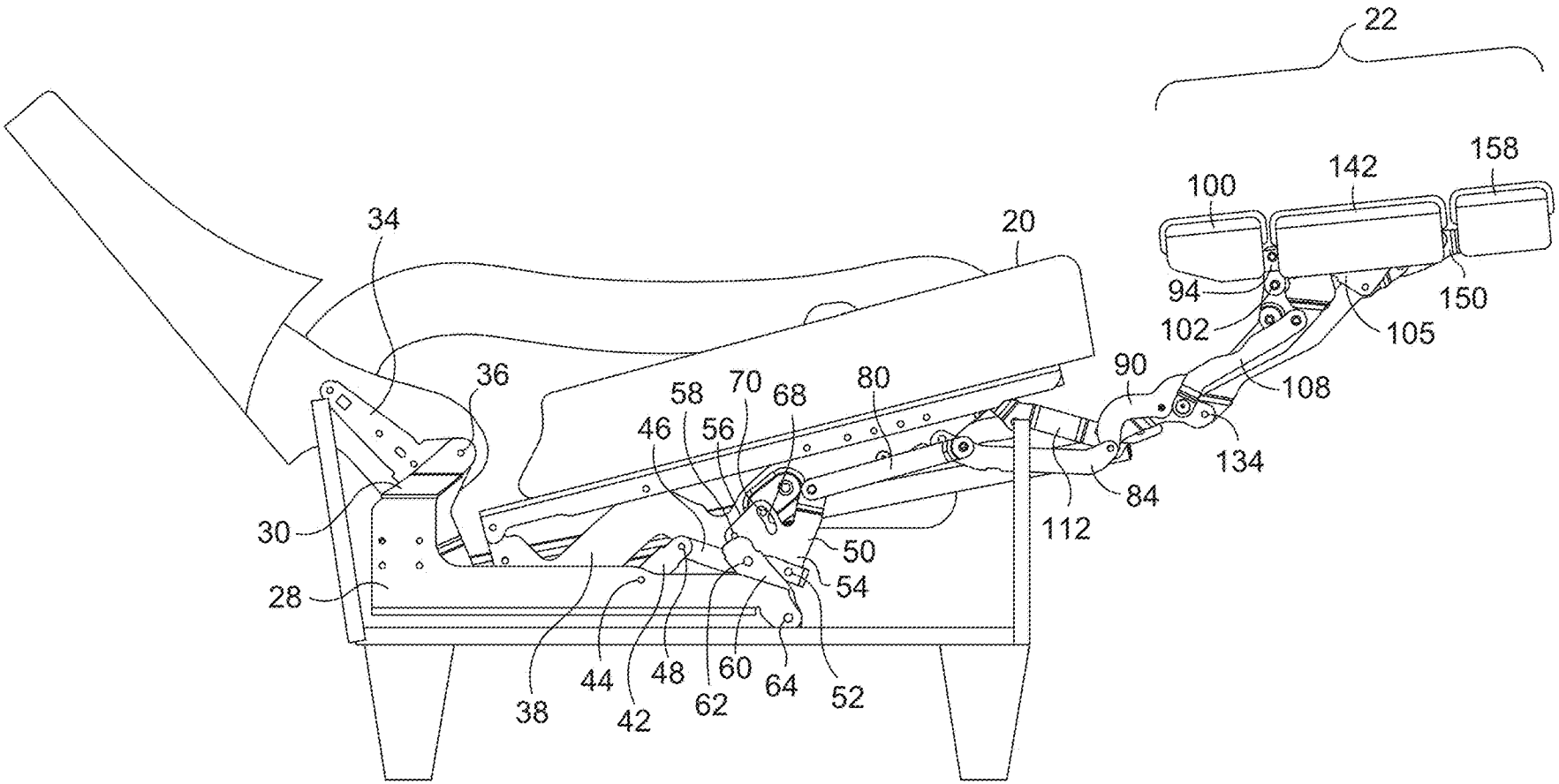
FIG. 9 is a side view similar to FIG. 8, but shown in the fully reclined position, in accordance with aspects herein.
Figure 10:
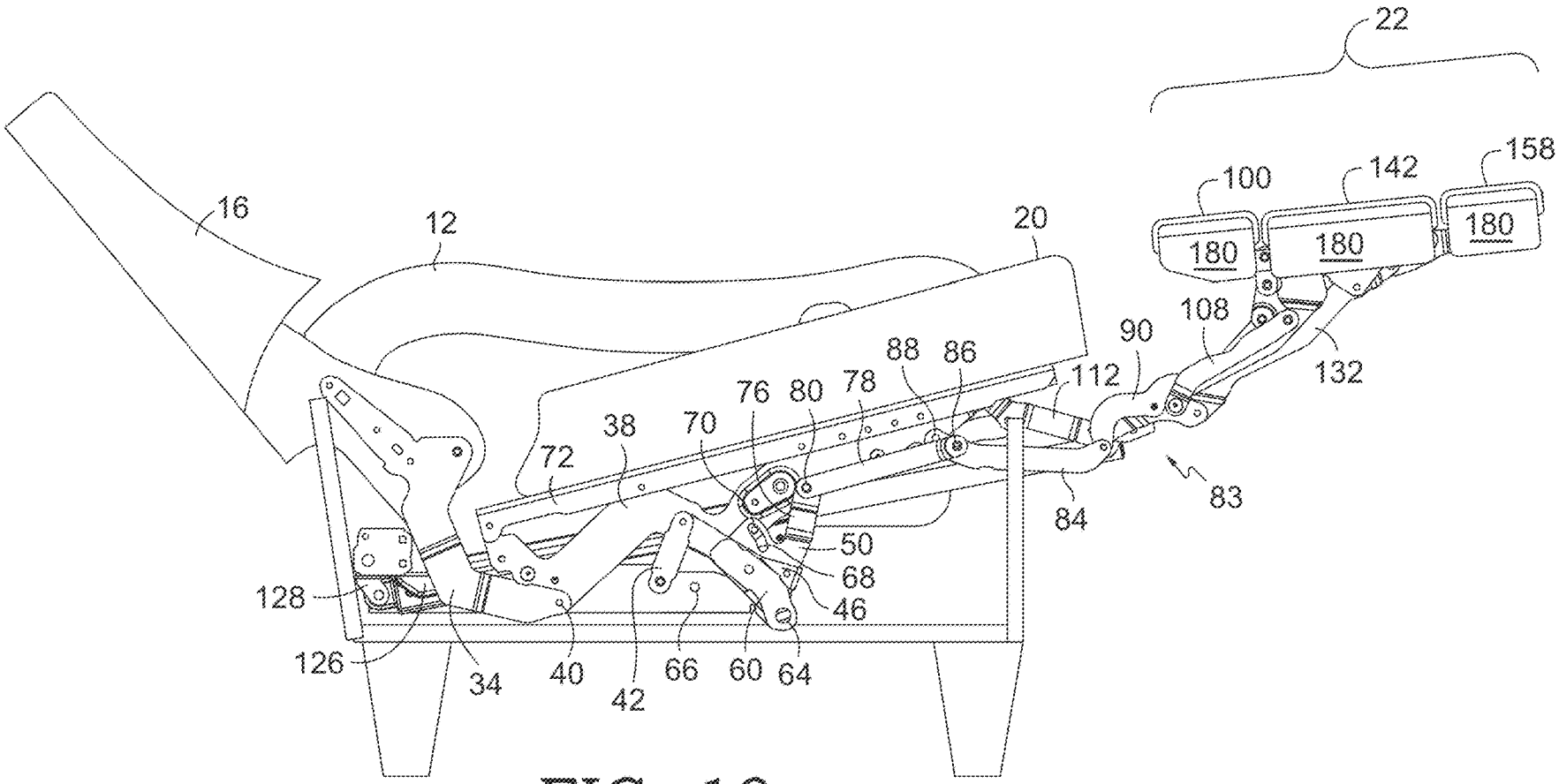
FIG. 10 is a view similar to FIG. 9, but shown with the baseplate hidden, in accordance with aspects herein.
Figure 11:
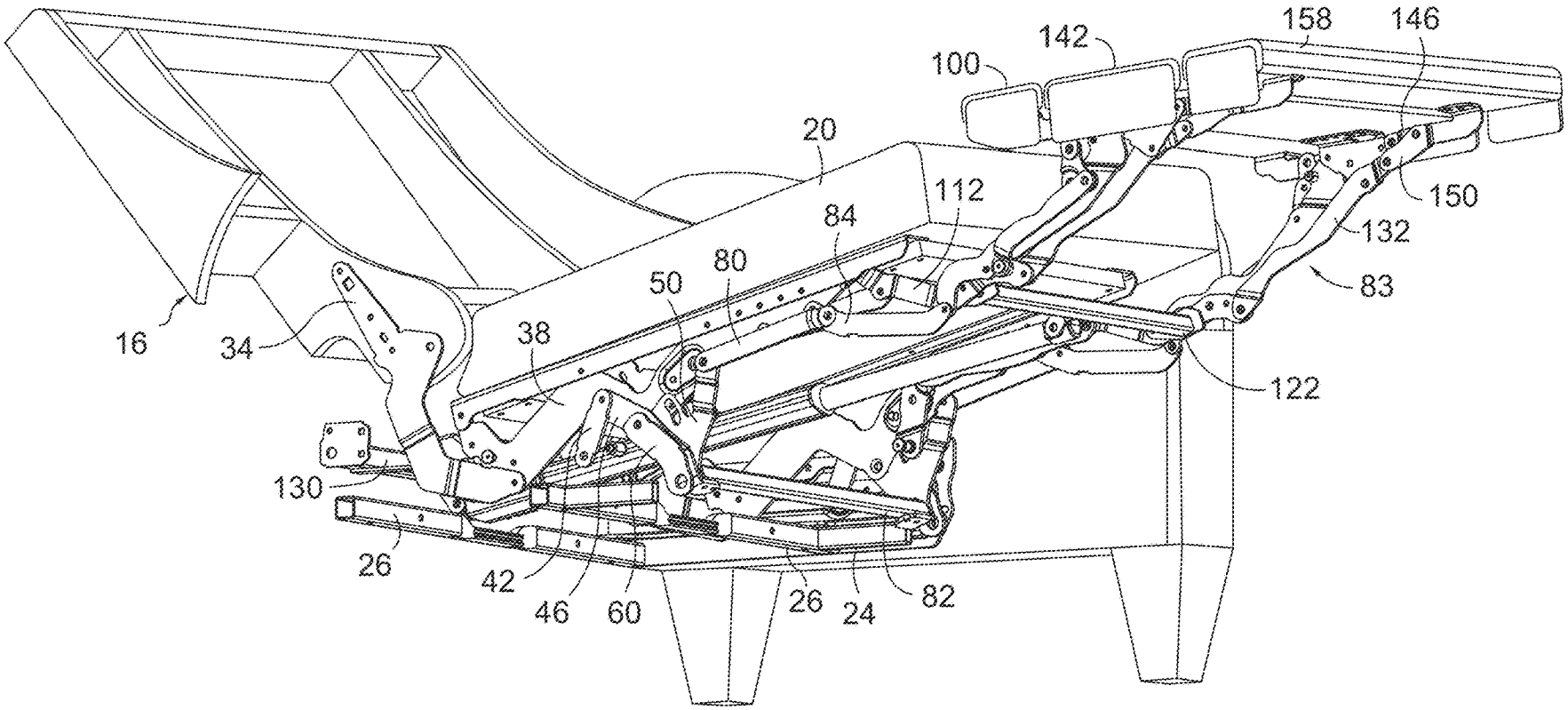
FIG. 11 is an enlarged, partial perspective view of FIG. 10, in accordance with aspects herein.

Each base plate 28 further includes a front portion 32 that pivotally supports the seat plate 38 as well. More specifically, as best seen in FIGS. 2, 3 and 4, a control link 42 is pivotally coupled to the base plate 38 at pivot point 44. The opposite end of the control link 42 is pivotally coupled to a front travel link 46 at pivot point 48. As best seen in FIG. 9, the opposite end of the front travel link 46 is pivotally coupled to a lift link 50 at pivot point 52. The lift link 50 is best seen in FIGS. 9-11. The lift link 50 has a front lower lobe 54 (which is pivotally coupled to the front travel link 46), and a rear lower lobe 56 which is pivotally coupled to the seat plate 38 at pivot point 58. Additionally, the front travel link 46 is pivotally coupled (between pivot points 48 and 52) to a pivot lift link 60 at pivot point 62. The pivot lift link 60 has a lower end that is pivotally coupled to the base plate 28 at pivot point 64. In some aspects, the base plate 28 has a stop 66 that interacts with a portion of the pivot lift link 60 that extends beyond pivot point 62, when the chair is in the closed position as seen in FIG. 3. As best seen in FIGS. 5 and 9, the lift link 50 also has a curved slot 68 formed therein that interacts with a pin 70 extending from the seat plate 38. The slot 68 on the lift link 50 acts as a stop and the rotation of the lift link 50 increases the angle (or pitch) of the seat 20 as the ottoman opens, to achieve a more comfortable position for the seat 20 in the TV and reclined positions. The back of the seat plate 38 is thus carried by the back bracket 34 (at pivot point 40), while the more forward portion of the seat plate 38 is carried by the combined linkage of the control link 42, the front travel link 46, the lift link 50 and the pivot lift link 60. As best seen in FIG. 7, the seat plate 38 is fixedly coupled to a seat angle 72 (such as at rivet or bolt locations labeled 74 in FIG. 4). In some aspects, the seat angle 72 may be coupled to the seat 20, and then coupled to the seat plate 38 thereafter for ease of assembly. The seat angle 72 is used to support the seat 20. Therefore, as the seat plate 38 moves, so does the seat 20.

As seen in FIG. 8, the lift link 50 also has an upper lobe 76 that is pivotally coupled to a lift control link 78 at pivot point 80. As the chair 10 moves from the closed position to the TV position, the lift control link 78 helps to drive the seat pitch change, through the linkage of the control link 42, the pivot lift link 60, the front travel link 46 and the lift link 50. The pin 70 moves from the lower position in slot 68 (see FIG. 4) to the upper position in slot 68 (see FIG. 8). Once at the TV position, the slot 68 in the lift link 50 limits further travel, and the recline linkage of the control link 42, the pivot lift link 60, and the front travel link 46 further lifts the seat 20 and moves the seat 20 forward (relative to the arms 12) (compare FIG. 8 to FIG. 10). As seen in FIG. 2, in some aspects, the front travel links 46 may be coupled to one another via a sequence tube 82.

Figure 14:
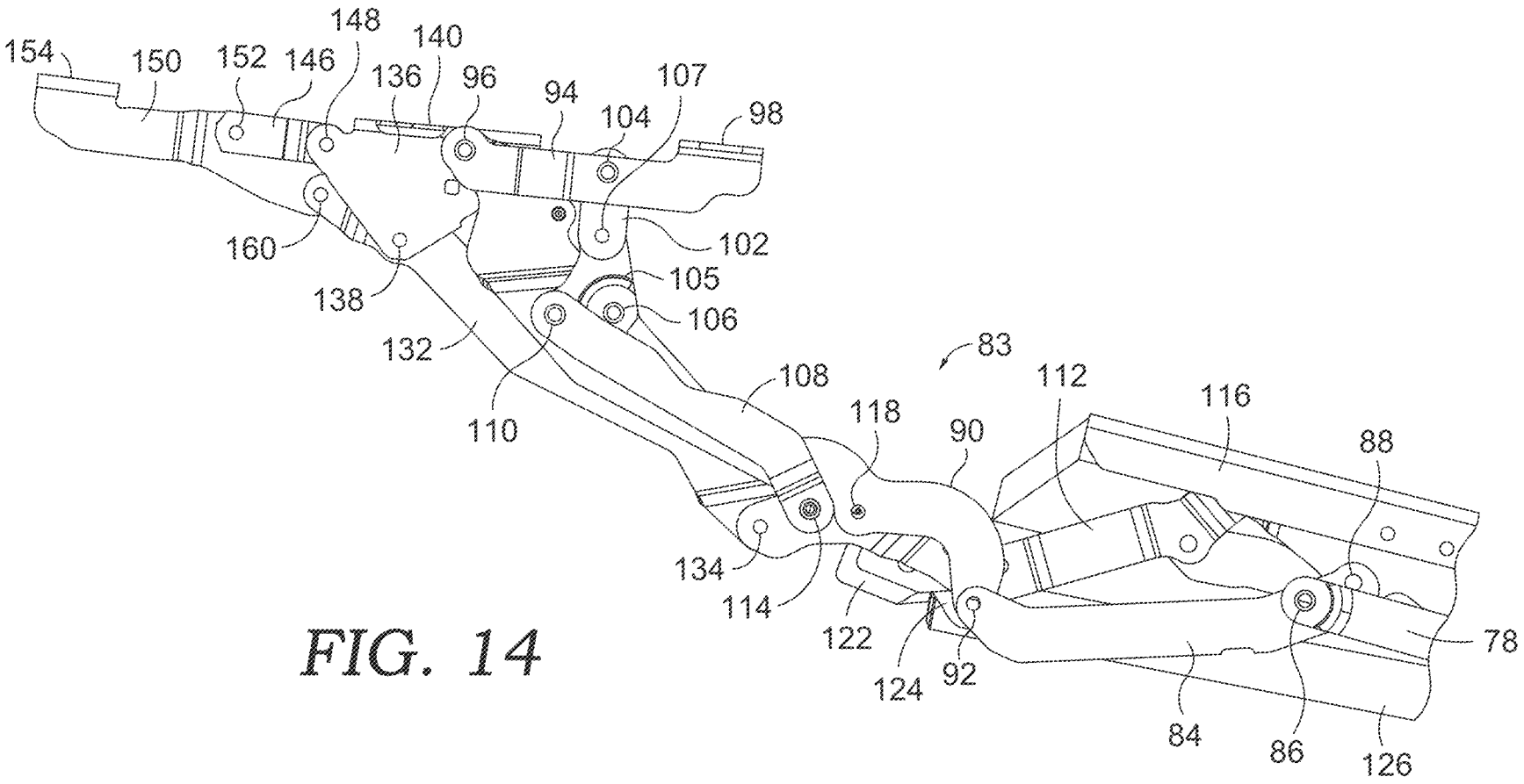
FIG. 14 is an enlarged, partial, perspective view of an extended ottoman linkage, with some parts hidden to reveal others.
Figure 16:
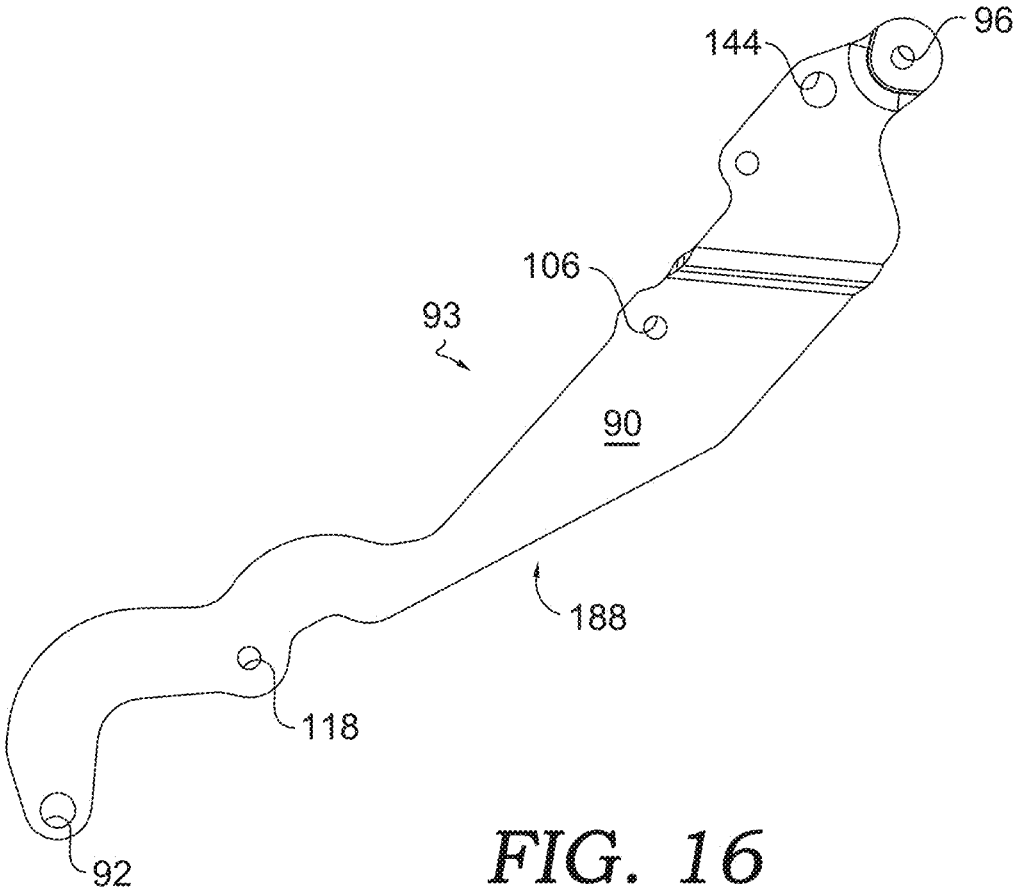
FIG. 16 is a view of the main ottoman link, oriented in the closed position.

As seen in FIG. 10, the lift control link 78 extends forwardly, and is coupled at its opposite end to a portion of an ottoman linkage 83. More specifically, the lift control link 78 is pivotally coupled to a rear ottoman link 84 at pivot point 86. Near pivot point 86, the rear ottoman link 84 is pivotally coupled to the seat plate 38 at pivot point 88. Opposite pivot point 86, the rear ottoman link 84 is pivotally coupled to a main ottoman link 90 at pivot point 92. The rear ottoman link 84 has a slight curve at each end. The main ottoman link 90 has a complex shape as shown in FIG. 16 (oriented in the closed position of FIG. 5). The upper end of the main ottoman link 90 is pivotally coupled to a mid-ottoman bracket 94 at a pivot point 96, as seen in FIG. 14. The mid-ottoman bracket 94 extends away from pivot point 96, with a flange 98 at the opposite end. The flange 98 is used to couple and support a mid-ottoman 100, as seen in FIG. 10. The notched area 93 of the main ottoman link 90 (as seen in FIG. 16) provides clearance for the mid-ottoman 100 in the closed position of FIG. 5 as more fully-described below. The somewhat curved shaped of the rear ottoman link 84 similarly provides clearance for the mid-ottoman 100.

A mid-ottoman control link 102 is pivotally coupled to the mid-ottoman bracket 94 at pivot point 104. The mid-ottoman control link 102 is also pivotally coupled to a generally triangularly shaped, mid-ottoman bellcrank 105 at pivot point 107. The mid-ottoman bellcrank 105 is also pivotally coupled to the main link 90 at pivot point 106. Further, the mid-ottoman bellcrank 105 is also pivotally coupled to an ottoman bellcrank control link 108 at pivot point 110. The end of the ottoman bellcrank control link 108 opposite pivot point 110 is pivotally coupled to a front ottoman link 112 at pivot point 114. As seen in FIG. 14, the ottoman bellcrank control link 108 includes a notched middle section to provide clearance for the mid-ottoman 100 in the closed position (as best seen in FIG. 5 and discussed further below).

Figure 15:
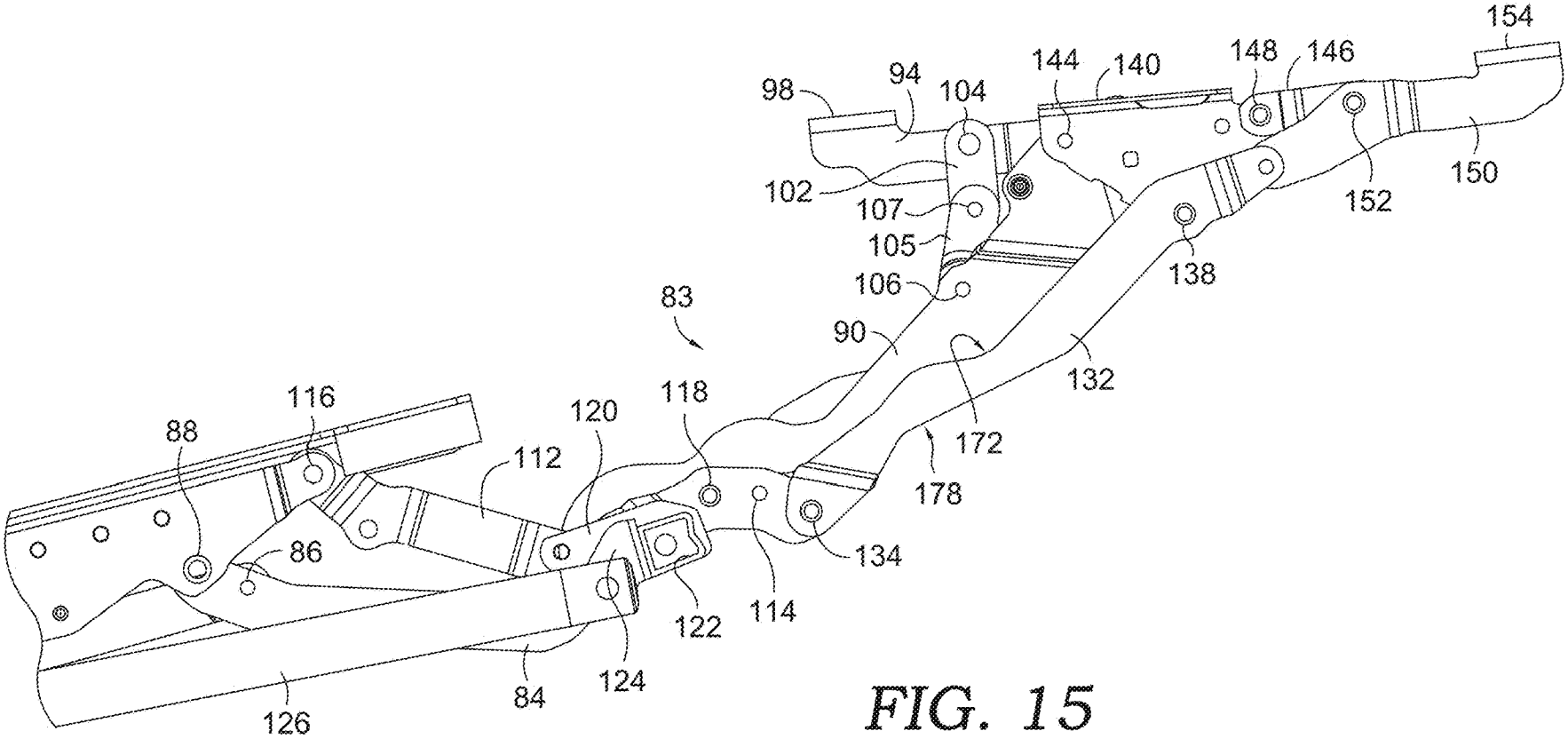
FIG. 15 is a view similar to FIG. 14, but from the inner side.

As seen in FIG. 15, the front ottoman link 112 is also pivotally coupled to the seat plate 38 at pivot point 116. The front ottoman link 112 is also pivotally coupled to the main ottoman link 90 at pivot point 118. As best seen in FIGS. 6 and 15, a motor tube bracket 120 may be fixedly coupled to each front ottoman link 112. The motor tube brackets 120 support a front motor tube 122, extending between the front ottoman links 112. The motor tube 122 also supports a bracket 124 that is used to pivotally couple a motor 126 to the front motor tube 122. As seen in FIGS. 11 and 12, the opposite end of the motor 126 is pivotally coupled to a rear motor tube 130 via a bracket 128.

Returning to FIG. 14, the end of the front ottoman link 112 opposite pivot point 116 is pivotally coupled to a lower ottoman link 132 at pivot point 134. The lower ottoman link 132 is also pivotally coupled to a main ottoman bracket 136 at a pivot point 138. The main ottoman bracket 136 may include a flange 140 that supports a main ottoman 142. As seen in FIG. 15, the main ottoman bracket 136 is also pivotally coupled to the main ottoman link 90 at a pivot point 144. Further, as seen in FIGS. 14 and 15, the main ottoman bracket 136 is also pivotally coupled to a drive link 146 at pivot point 148. The end of the drive link 146 opposite pivot point 148 is pivotally coupled to a flipper ottoman bracket 150 at a pivot point 152. The flipper ottoman bracket 150 may include a flange 154 that supports a flipper ottoman 158 (as seen in FIG. 8). The flipper ottoman bracket 150 is also pivotally coupled to the lower ottoman link 132 at pivot point 160.

Figure 6A:
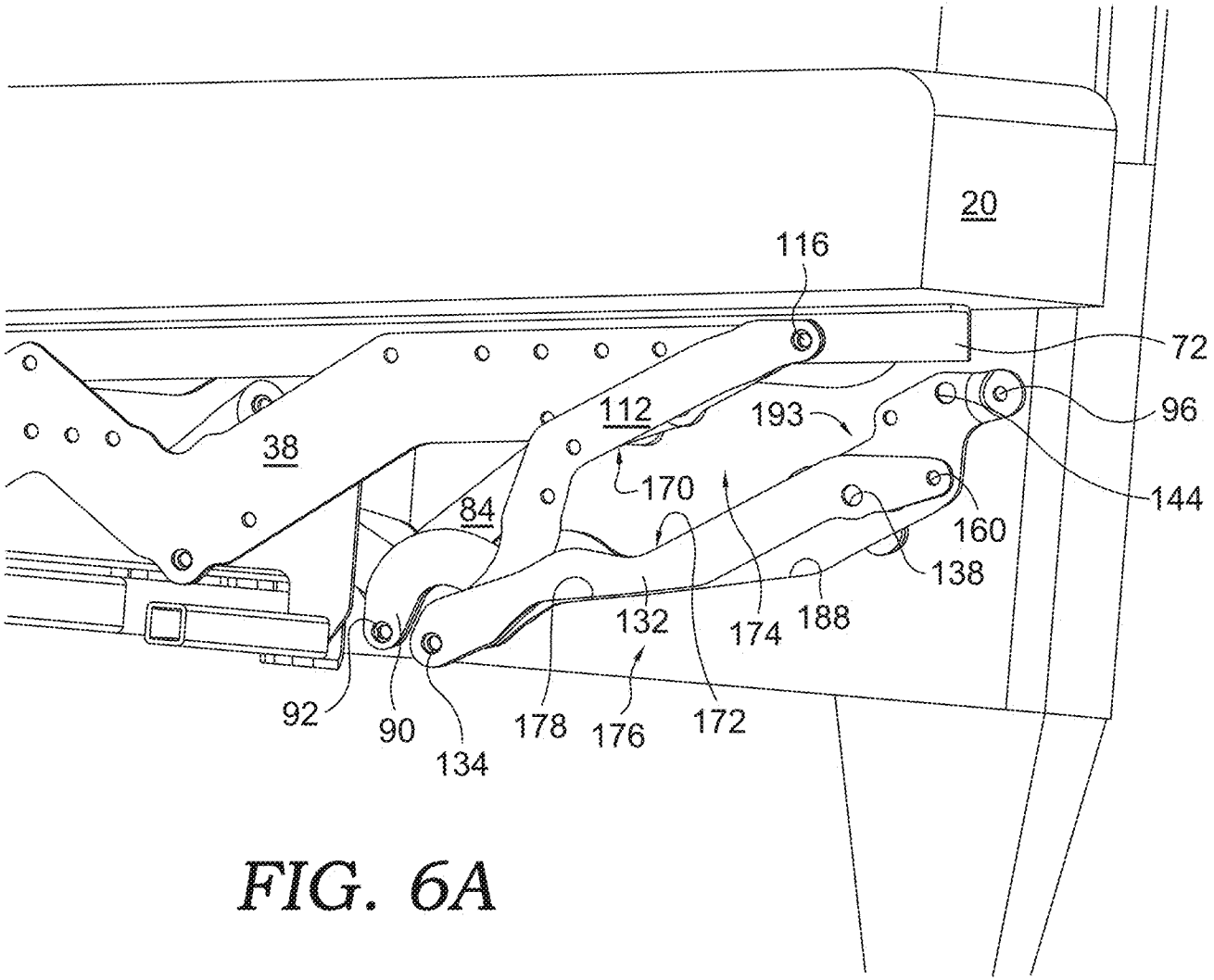
FIG. 6A is a view similar to FIG. 6, shown with additional parts removed to reveal detailed construction of other links.
Figure 6B:
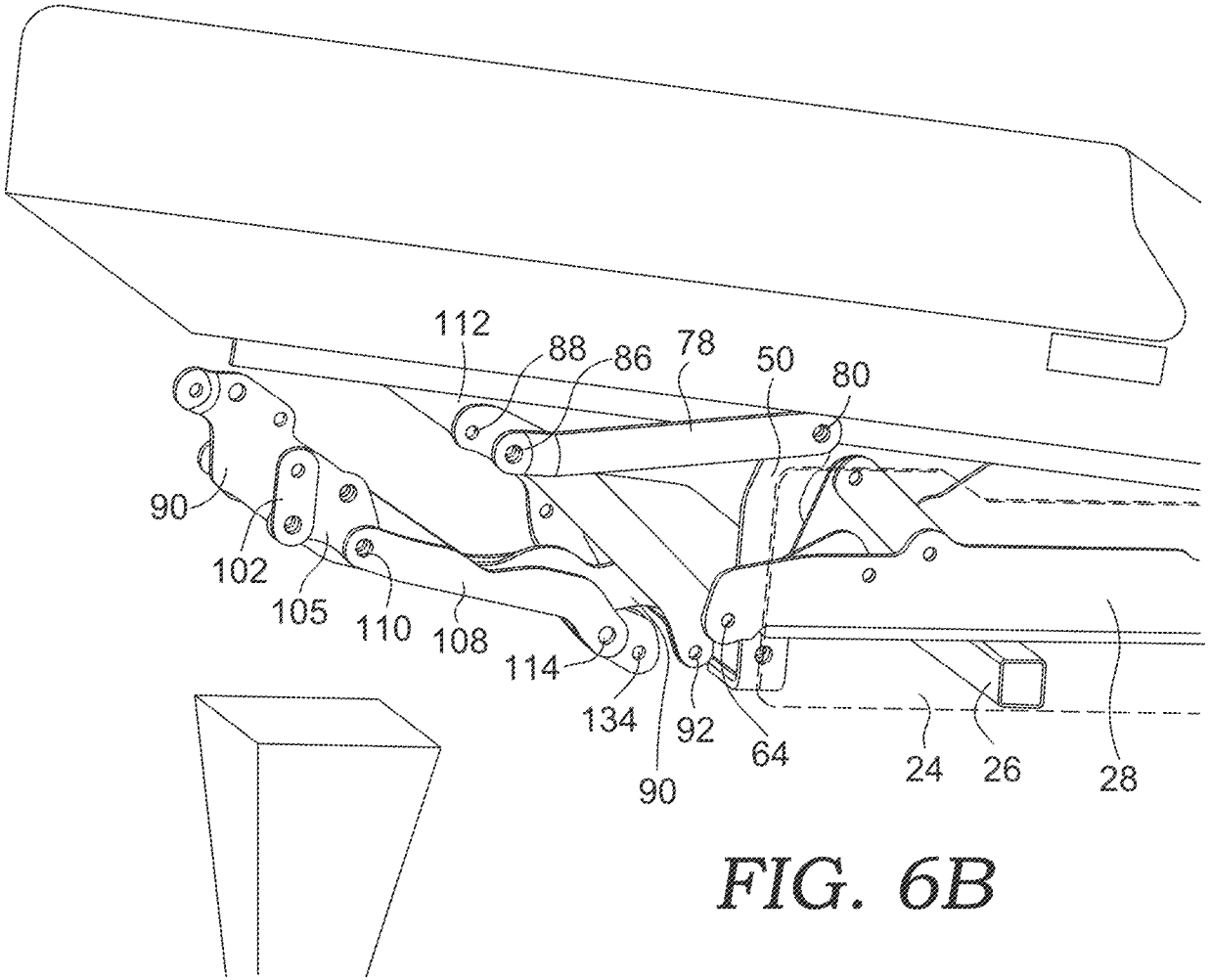
FIG. 6B is a view similar to FIG. 6A, shown from a different perspective.

As can be seen in FIG. 6A, the front ottoman link 112 may be shaped with a bend, providing a clearance section 170 for the mid-ottoman 100 (when in the closed position). Similarly, the above-described slight bend in the rear ottoman link 84 aides in providing similar clearance. The lower ottoman link 132 may include a similar relief notch 172, which, along with notched area 93 in the main ottoman link 90, also provides clearance for the mid-ottoman 100. When in the closed position of FIG. 5, a mid-ottoman void 174 is created, allowing the mid-ottoman 100 to be stowed behind the main ottoman 142 in the closed position (compare FIGS. 5 and 6). Similarly, a flipper void 176 is created for the flipper ottoman 158 in the closed position of FIG. 5. The flipper void 176 is created, in part, due to a flat section 178 on the lower ottoman 132 (see FIGS. 6A and 15) and a flat section 188 on the main ottoman link 90 (see FIGS. 6A and 16. The flipper void area 176 allows the flipper ottoman 158 to be stowed behind the main ottoman 142 and below the mid-ottoman 100 in the closed position. Because the mid-ottoman void 174 and the flipper void 176 extend substantially from one arm 12 to the other, the mid-ottoman 100 and the flipper ottoman 158 extend the width of the seat 20 (see FIG. 12) (with the shrouds inset).

Also, from the perspective of FIGS. 5 and 15, the mechanism 18 rotates the main ottoman bracket 136 (and thus the main ottoman 142) and the flipper ottoman bracket 150 (and thus the flipper ottoman 158) in a counter-clockwise rotation from the closed position to the TV position. In contrast, the mid-ottoman bracket 94 (and thus the mid-ottoman 100) rotates in a reverse (clockwise from the viewpoint of FIGS. 5 and 15) direction. By reversing the direction of rotation of the mid-ottoman 100, the mid-ottoman 100 and the flipper ottoman 158 can be held relatively close to one another in the closed position, with the mid-ottoman 100 sitting slightly above the flipper ottoman 158.

Figure 13:
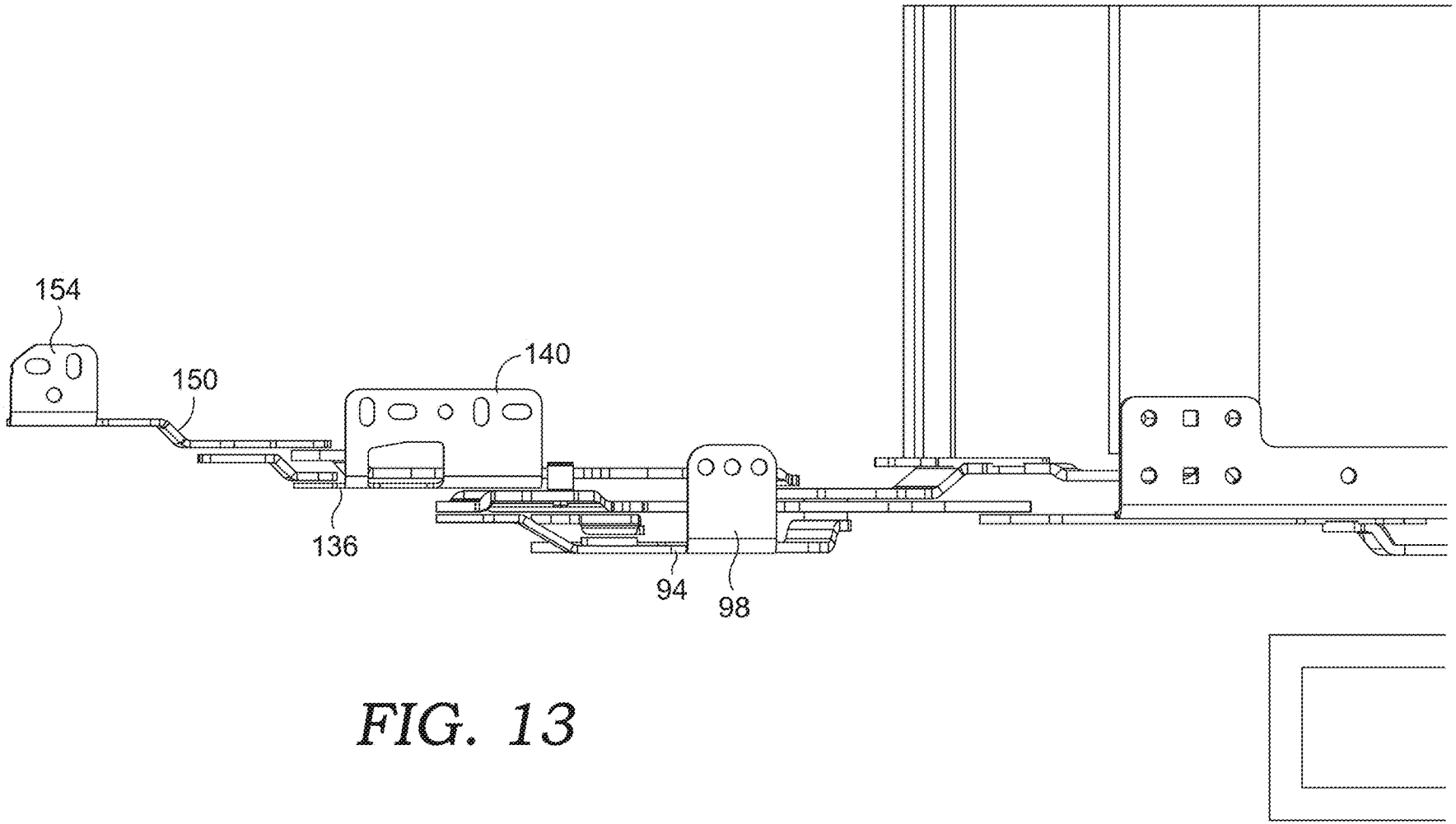
FIG. 13 is a partial, enlarged top view, shown without the ottomans.

Additionally, as seen in FIG. 13, the flipper ottoman bracket 150 sits inward from the main ottoman bracket 136. The main ottoman bracket 136 in turn sits inward from the mid-ottoman bracket 94. In this construction, each of the mid-ottoman 100, the main ottoman 142 and the flipper ottoman 158 may extend the width of the seat 20. This nested construction also allows each of the mid-ottoman 100, the main ottoman 142 and the flipper ottoman 158 to include a side shroud 180 (see e.g. FIGS. 2 and 3, where the side shroud 180 for the flipper ottoman 158 does not interfere with the side shroud 180 for the mid-ottoman 100). Additionally, as best seen in FIGS. 7, 10 and 12, which each of the mid-ottoman 100, the main ottoman 142 and the flipper ottoman 158 are separate, in the TV and fully-reclined positions, the mid-ottoman 100 is adjacent the main ottoman 142, which is, in turn, adjacent the flipper ottoman 158. In some aspects, the chair 10 may be finished and upholstered such that, in the TV and fully-reclined positions, the mid-ottoman 100 abuts the main ottoman 142, which is, in turn, abuts the flipper ottoman 158. This allows the ottoman 22 to effectively function as a one-piece, unitary ottoman with a clean look (especially when side shrouds 180 are used) and effectively offers a one-piece support surface, while at the same time allowing the mid-ottoman 100, the main ottoman 142 and the flipper ottoman 158 to be stowed below the seat 20 and above the bottom of the arms 12 (allowing a high-leg styling). As seen in FIG. 10, the side shrouds obscure at least some portions of the ottoman linkage 83 when the chair is in the extended or fully reclined positions.

In the closed position, the mechanism 18 allows a clean front edge of the chair 10, with the top of the main ottoman 142 in line with the front of the seat 20, as seen in FIG. 2, with the mid-ottoman 100 and the flipper ottoman 158 stowed below the seat 20 and behind the main ottoman 142. As the motor 126 extends, the motor 126 acts on the front ottoman links 112 to extend the ottoman 22 to the position of FIG. 7. As the ottoman 22 extends, the pitch of seat 20 also changes, as discussed above. Also, because the mechanism 18 is carried on cross tubes 26 and chassis plates 24, it is more easily installed into the frame of the chair 10.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A high leg seating unit moveable between closed, extended and fully reclined positions, the seating unit comprising;

two sides spaced from one another, each side having a lower edge and an upper edge spaced apart from the lower edge;

a seat extending between the two sides;

an extendable ottoman including a mid-ottoman, a main ottoman and a flipper ottoman;

a chair back extending upwardly from a rearward edge of the seat;

a linkage mechanism supported between the sides and coupling at least the seat, the extendable ottoman, and the chair back, the linkage mechanism including an ottoman linkage with links shaped to create a first void accommodating the mid-ottoman in the closed position and a second void accommodating the flipper ottoman in the closed position; and a motor coupled to the linkage mechanism to move the seating unit between the closed, extended and fully reclined positions, wherein each of the main ottoman, the mid-ottoman and the flipper ottoman comprises a side shroud.

2. The seating unit of claim 1, further comprising a pair of chassis plates, wherein one of the chassis plates is coupled to one of the two sides, and wherein the linkage mechanism is supported between the chassis plates.

3. The seating unit of claim 2, wherein the pair of chassis plates are coupled to one another by way of a pair of rigid cross-tubes.

4. The seating unit of claim 3, wherein each of the pair of rigid cross-tubes comprises two side portions and a central portion, wherein the central portion of each of the pair of rigid cross-tubes has a smaller cross-section than the two side portions of the pair of rigid cross-tubes.

5. The seating unit of claim 3, wherein in the closed position, the mid-ottoman is stowed above the flipper ottoman.

6. The seating unit of claim 2, wherein the linkage mechanism includes links that change the pitch of the seat in moving from the closed position to the extended position.

7. The seating unit of claim 1, further comprising:

a back bracket and a seat plate, wherein a lower end of the back bracket is pivotally coupled to the seat plate at a pivot point.

8. The seating unit of claim 1, wherein the ottoman linkage further comprises a rear ottoman link coupled to a lower ottoman link, wherein the lower ottoman link comprises a relief notch.

9. A high leg seating unit adjustable between closed, extended and fully reclined positions, the high leg seating unit comprising:

two sides and a seat extending between the two sides a first width;

a mid-ottoman, a main ottoman and a flipper ottoman forming an ottoman assembly, each of the mid-ottoman, the main ottoman, and the flipper ottoman extending between the two sides the first width;

a chair back coupled to the seat;

a linkage mechanism supported between the sides and coupling at least the seat, the ottoman assembly and the chair back;

wherein the linkage mechanism includes an ottoman linkage, the ottoman linkage comprising links shaped to create a first void accommodating the mid-ottoman in the closed position and a second void accommodating the flipper ottoman in the closed position; and a motor coupled to the linkage mechanism to move the seating unit between the closed, extended and fully reclined positions.

10. The seating unit of claim 9, further comprising a pair of chassis plates, wherein one of the chassis plates is coupled to one of the two sides, and wherein the linkage mechanism is supported between the chassis plates.

11. The seating unit of claim 10, wherein the pair of chassis plates are coupled to one another by way of a pair of rigid cross-tubes.

12. The seating unit of claim 11, wherein each of the pair of rigid cross-tubes comprises two side portions and a central portion, wherein the central portion of each of the pair of rigid cross-tubes has a smaller cross-section than the two side portions of the pair of rigid cross-tubes.

13. The seating unit of claim 9, wherein the ottoman linkage further comprises a rear ottoman link coupled to a lower ottoman link, wherein the lower ottoman link comprises a relief notch.

14. The seating unit of claim 9, further comprising:

a back bracket and a seat plate, wherein a lower end of the back bracket is pivotally coupled to the seat plate at a pivot point.

15. An adjustable seating unit, comprising;

a seat and two sides;

a mid-ottoman, a main ottoman and a flipper ottoman, the mid-ottoman having a mid-ottoman top surface, the main ottoman having a main ottoman top surface, and the flipper ottoman having a flipper ottoman top surface;

a chair back coupled to the seat;

a linkage mechanism coupled to at least the seat, the mid-ottoman, the main ottoman, the flipper ottoman and the chair back;

wherein the linkage mechanism comprises a plurality of links shaped to create a first void for accommodating the mid-ottoman and a second void for accommodating the flipper ottoman; and a motor coupled to the linkage mechanism to move the seating unit between a closed, an extended and a fully reclined position, wherein the mid-ottoman top surface, the main ottoman top surface, and the flipper ottoman top surface are substantially co-planar in at least one of the extended position and the fully-reclined position.

16. The seating unit of claim 15, further comprising a pair of chassis plates, wherein one of the chassis plates is coupled to one of the two sides, and wherein the linkage mechanism is supported between the chassis plates.

17. The seating unit of claim 16, wherein the pair of chassis plates are coupled to one another by way of a pair of rigid cross-tubes.

18. The seating unit of claim 17, wherein each of the pair of rigid cross-tubes comprises two side portions and a central portion, wherein the central portion of each of the pair of rigid cross-tubes has a smaller cross-section than the two side portions of the pair of rigid cross-tubes.

19. The seating unit of claim 15, further comprising:

a back bracket and a seat plate, wherein a lower end of the back bracket is pivotally coupled to the seat plate at a pivot point.

20. The seating unit of claim 15, wherein the mid-ottoman top surface, the main ottoman top surface, and the flipper ottoman top surface are substantially co-planar in both the extended position and the fully-reclined position.

* * * * *